United States Patent [19]

Mertens

[11] Patent Number: 4,653,666

[45] Date of Patent: Mar. 31, 1987

[54] PACKAGE AND DISPENSER FOR ADHESIVE COATED NOTEPAPER

[75] Inventor: Timothy A. Mertens, Cottage Grove, Minn.

[73] Assignee: Minnesota Mining and Manufacturing Company, St. Paul, Minn.

[21] Appl. No.: 747,337

[22] Filed: Jun. 21, 1985

[51] Int. Cl.[4] ..... B65H 1/04

[52] U.S. Cl. ..... 221/45; 221/58; 221/59; 221/56

[58] Field of Search ..... 221/22, 66, 33, 45, 221/46, 56, 58, 59, 64, 197, 198, 279, 305, 307, 309, 47, 48, 50–52, 55, 312 R; 312/50, 60, 61; 206/39.3, 39.7, 39.8, 39, 449, 555, 556

[56] References Cited

U.S. PATENT DOCUMENTS

| | | | |
|---|---|---|---|
| 1,951,413 | 3/1934 | Hope | 221/48 |
| 2,323,395 | 7/1943 | Harwood | 221/48 |
| 2,334,536 | 11/1943 | Broeren et al. | 221/48 |
| 2,802,567 | 8/1957 | Covel | 206/449 |
| 2,890,791 | 6/1956 | Wenzel | 221/48 X |
| 3,083,866 | 4/1963 | Strange | 221/48 |
| 3,265,241 | 8/1966 | McColgan | 221/47 |
| 3,369,698 | 2/1968 | Scholz | 221/48 |
| 3,369,699 | 2/1968 | Enloe et al. | 221/48 |
| 3,604,562 | 9/1971 | Loeffler | 221/56 X |
| 4,416,392 | 11/1983 | Smith | 221/59 X |

*Primary Examiner*—Charles A. Marmor
*Assistant Examiner*—David H. Bollinger
*Attorney, Agent, or Firm*—Donald M. Sell; James A. Smith; John C. Barnes

[57] ABSTRACT

Notepaper dispensers formed from inexpensive card stock material tend to weaken and tear when subjected to concentrated forces, and the dispenser of the present patent is provided with lengths of polymeric material adjacent the edges of the dispensing opening which will bend and flex more reliably, and a biasing member is disposed in the container for biasing the notepaper toward the dispensing opening.

11 Claims, 6 Drawing Figures

PACKAGE AND DISPENSER FOR ADHESIVE COATED NOTEPAPER

BACKGROUND OF THE INVENTION

1. Field of the Invention

This invention relates to an improvement in dispensers for notepaper, and in one aspect to an improved dispenser formed of inexpensive card stock but having reliability during the dispensing of the entire supply of notepapers therefrom.

2. Description of the Prior Art

The present invention provides an improvement in a dispenser for dispensing serially sheets of material which are provided in a stack. Prior dispensers for sheets of notepaper are known, and specifically, U.S. Pat. No. 4,416,392, issued Nov. 22, 1983, and assigned to the assignee of this application, discloses a dispenser for dispensing sheets of material wherein each sheet is adhered to the next adjacent sheet by a narrow band of adhesive material with the adhesive coated on one side of each sheet on alternately opposite edges of successive sheets. In the embodiment of the dispenser shown in the patent the sheets were dispensed from a stack through an opening in the package for the stack of material. In one embodiment the stack of sheets is moved upwardly toward the top of the dispenser where the walls defining the top of the dispenser were inclined with respect to each other. In the dispenser illustrated the construction was usable as a refillable desk dispenser and was formed from rigid material. In the embodiment formed from paper stock, the sheets were not urged toward the opening and the dispenser was provided with a slot through which the sheets could be withdrawn from the stack. Withdrawing one sheet from the stack removed the next adjacent sheet due to the adhesive coating on one edge of one sheet withdrawing through the opening the adhesive-free edge of the next adjacent sheet as the sheets were dispensed. The dispensed sheet was then peeled from the next adjacent sheet where the edges were adhered together by a repositionable adhesive. When the stack in such a dispenser was partially used the force necessary to withdraw the sheets from the dispenser was no longer greater than the force necessary to peel the dispensed sheet from the next adjacent sheet and thus the dispensing force would withdraw sheets from the dispenser successively without separation.

Improvements to maintain the dispensing force greater than the peel force to separate the sheets led to the development of several novel dispensers wherein the dispensing opening was formed by flexible flaps of card stock which overlap. These flaps relied on the resilience of the card stock to close the flaps, for permitting the peeling of the dispensed sheet from the next sheet and for supporting the free end of the adjacent sheet in a position to be readily grasped and dispensed.

In each of these dispensers it was found that they caused a curl to be formed in the sheets of notepaper which extended across the sheet parallel to the adhesive coated edge. This curl caused the edge of the note sheet opposite the adhesive coated edge to stand up from the receptor surface. This has a negative effect as the note sheets are more easily dislodged from the receptor surface as a result of the transverse curl. Further, the earlier designs caused the working or reaction forces as the sheets were dispensed to be concentrated in areas adjacent the edges of the dispensing openings. This concentration of the dispensing forces made the earlier card stock dispenser prone to tearing along the edges and soon the dispensers were ineffective for maintaining the dispensing force greater than the peeling force necessary to separate a dispensed sheet from the adjacent sheet. Further, different ambient environments for the dispensers formed of card stock resulted in the material becoming limp if exposed to too much humidity or brittle when too dry and making the same inconsistent as to their performance for dispensing the notepaper sheets.

It is therefore an object of the present invention to provide a disposable, reliable, easily decorated and readily processed and packaged dispenser for sheets of notepaper placed in a stack with each sheet adhered to the next adjacent sheet by a narrow band of adhesive material coated on one side of each sheet adjacent alternately opposite edges of successive sheets.

The dispenser of the present invention will be provided with means for maintaining the dispensing of the notepapers consistent throughout the stack of notepaper. The dispenser is disposable but yet durable during the dispensing operation.

The notepaper dispenser of the present invention is particularly novel in that flaps of flexible polymeric material are disposed along the dispensing opening to bend and define a surface over which the sheets are drawn as they are dispensed. The bowed or curved dispensing edge restricts the bow or curl developing transversely of the notepaper sheets during the dispensing operation. The dispenser is also formed with a biasing means within the dispenser to bias the sheets toward the dispensing opening such that the dispensing force will exceed the peeling force and all of the sheets will be dispensed in a generally consistent manner as concerns force, curl, and sheet separation.

SUMMARY OF THE INVENTION

The present invention provides an improved package from which a stack of sheet material such as utilized for notes, routing slips, labels, place marks, messages or reminders may be dispensed. The sheets are releasably adhered along alternately opposite edges to successive sheets such that the sheets are adhered together in a stack but are readily peeled apart when a peeling force is placed on the sheets adjacent said edges. The dispenser comprises a box-like package having a bottom, side walls, and a top wall in which is formed a generally centrally disposed transverse opening. A flap extends from each edge of the opening toward the opposite edge. These flaps are formed of a polymeric film which is flexible and the flaps extend toward each other but leave a dispensing opening between the opposed edges between which the sheets of material may be withdrawn. The polymeric material is preferably adhered to the inner surface of the top wall. A stack of sheet material is positioned within the box-like package. Biasing means are disposed within the box-like package to urge the stack of sheets toward the top wall to be dispensed through the dispensing opening.

The flaps of polymeric material may be continuous across the transverse dimension of the top wall or may be formed with a slit intermediate the transverse dimension of the package to increase their flexibility. Alternatively the flaps may be formed with extended end portions which will bow during the initial dispensing forces being applied to a sheet of notepaper and direct the bending forces along the extended dimension of the flaps.

The edges of the box-like package at the slot may also be formed with projections which will fold upwardly from the plane of the top as the dispensing action is applied to the note sheets and the projected portions support the sheets in such a manner that they can be readily grasped and pulled from the dispenser.

The biasing means within the dispenser may take any form of inexpensive spring-like members such as coiled wire, polymeric foams, folded paper or plastic materials. The biasing material selected for use in a dispenser as hereinafter described should exert a force on the top of the stack of not more than 125 grams per cm length of transverse opening.

BRIEF DESCRIPTION OF THE DRAWING

The present invention will be described in greater detail with reference to the accompanying drawing wherein.

DETAILED DESCRIPTION OF THE PRESENT INVENTION

Figure 1:
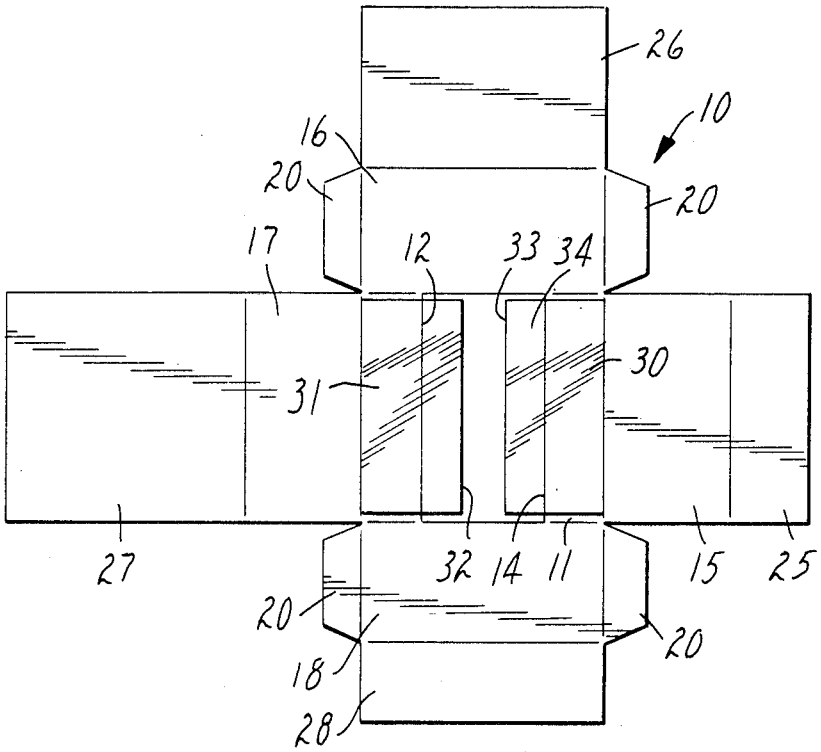
FIG. 1 is a plan view of a box blank utilized to form a dispenser of the present invention.

Referring now to the drawing there is described a dispenser for dispensing sheets of notepaper which are each provided with a coating of a repositionable pressure-sensitive adhesive along one edge of the sheet or an adhesive having a controlled release from the surface of the adjacent sheet. The sheets are formed in a stack with the adhesive coated edge of adjacent sheets disposed at alternately opposite edges of the stack.

The dispensers are preferably all formed from an inexpensive card stock which may be easily decorated and readily processed. The card stock useful in the dispenser of the present invention may consist of any number of paper materials including solid bleached sulphite, clay-coated newsback or any other coated or uncoated paper-like card stock material whether new or recycled material. The properties of the card stock should be similar to the preferred material which is a 20 point solid bleached sulphite.

The notepaper being dispensed is typically a sheet of 20 pound bond paper 2.75 inches (7 cm) by 3.00 inches (7.62 cm) having a coating of pressure-sensitive adhesive along one edge of the sheet which narrow band of adhesive material extends between 0.25 inch (0.635 cm) and 0.750 inch (1.9 cm) from the edge of the sheet. An example of the adhesive material is a pressure-sensitive repositionable acrylate copolymer adhesive, as described in U.S. Letters Pat. No. 3,691,140, assigned to the assignee of this application.

Referring now to FIG. 1 there is illustrated a box blank from which may be formed a dispensing package according to the present invention. The box blank generally designated 10 comprises a centrally disposed generally rectangular section 11 in which an opening is formed. The opening is defined by the opposed spaced edges 12 and 14 which extend the width of section 11. Radiating from each side of the central section 11 and joined thereto by fold lines are side wall panels 15, 16, 17, and 18. Projecting from the edges of the panels 16 and 18 are tabs 20 which are used to seal the side walls together and radiating from the side walls 15, 16, 17, and 18 are flaps 25, 26, 27, and 28, respectively, which form the bottom wall of the dispenser. Adhered to the inner surface of the central section 11 which forms the top wall for the box-like dispensing package are a pair of pieces or strips of polymeric material 30 and 31. The pieces of polymeric material 30 and 31 extend past the edges 12 and 14 which define the opening in the top panel. The distal edges 32 and 33 of the polymeric pieces 30 and 31 remain in spaced position with respect to each other to define therebetween a dispensing opening.

Figure 2:
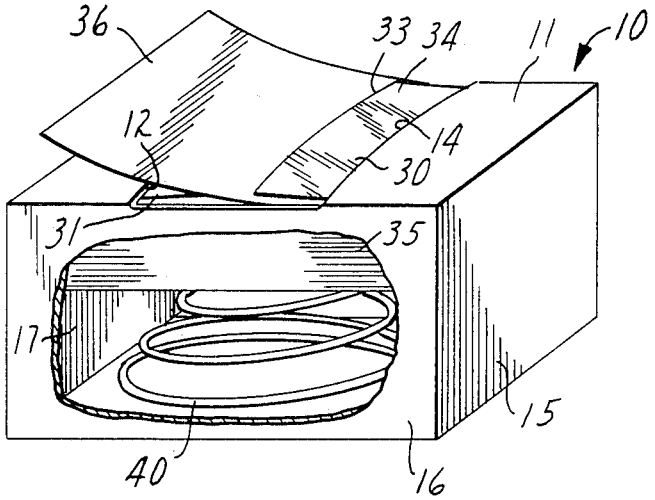
FIG. 2 is a perspective view of a notepaper dispenser constructed according to the present invention having one portion thereof broken away to show the interior of the package.

Referring now to FIG. 2 there is shown the dispensing package formed from the blank 10 and having disposed interiorly thereof a stack 35 of individual sheets 36 of the notepaper material, each sheet having the narrow band of adhesive material formed along one edge and the adhesive coated edges are parallel with respect to the edges 12, 14, 32, and 33.

As is illustrated in FIG. 2, it is normal for the card stock material to bend or bow outward along the edges 12 and 14 and form a convex surface near the center of the top panel 11. This is typical of any box formed of card stock material. The flap 34 formed by the polymeric sheet 30 extending beyond the edge 14 to the edge 33 accepts the same bow as the top panel. The polymeric material however has sufficient flexibility that raising the free edge of the sheet 36 to pull the same through the opening between the flaps will initially apply forces at opposite edges of the flap but the same will then develop a reverse bend extending along the flap and parallel with the edge 12 or 14. The arcuate surface of the bent flap will engage the sheet as it is withdrawn from the dispenser. The free edge of the adjacent sheet will be drawn with the sheet 36 through the opening. Contact between the sheet and the bowed flap will cause the sheet to be dispensed without developing a retained curl in the sheet.

In a dispenser package, the opening between the edges 12 and 14 is typically 1.5 inches (3.8 cm) wide and 2.9 inches (7.36 cm) in length which length extends across the 2.75 inch dimension of the sheets. The strips 30 and 31 have a dimension of 1.25 inches by 2.75 inches (3.17 cm by 7 cm) and the strips extend 0.50 inch (1.27 cm) beyond the edge 12 or 14 into the opening.

Positioned beneath the stack 35 of sheets in the dispenser is a biasing means illustrated in the form of a wire spring 40. This spring 40 may be spirally wound to be a compression spring or may take the form of a block of open or closed cell polymeric foam which will exert sufficient force when compressed to lift the stack 35 of sheet material 36 toward the dispensing opening. This force preferably is less than 125 grams per cm length of transverse opening, but can range from 12.5 grams to 125 grams per cm length of transverse opening, over the dispensing operation of a stack of 300 sheets.

Figure 3:
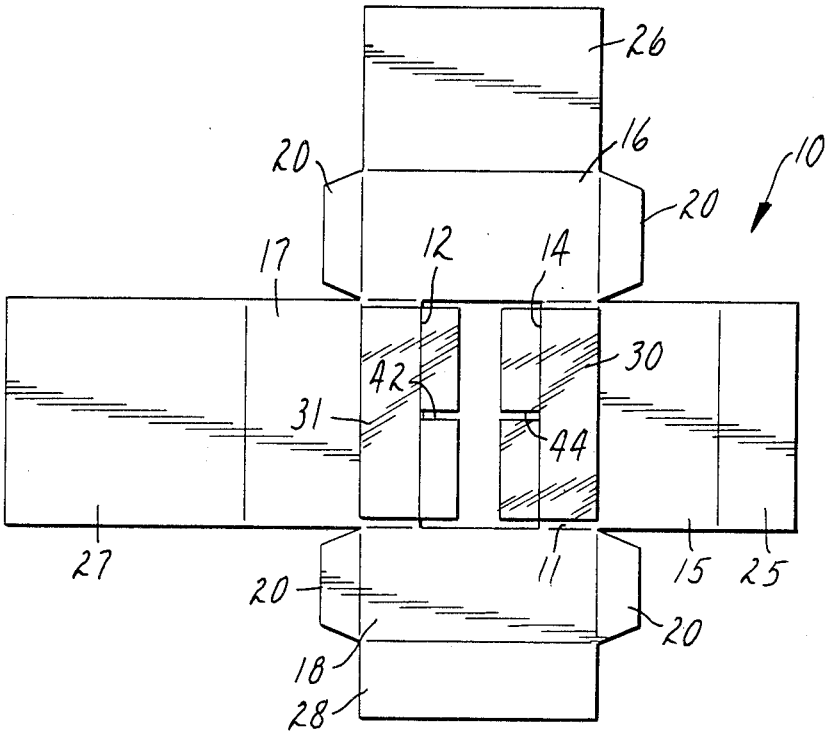
FIG. 3 is another plan view of a box blank constructed to form the dispensing package of the present invention.

FIG. 3 shows a box blank 10 corresponding to that of FIG. 1 with a central section 11 and radiating side panels 15, 16, 17, and 18. This blank differs in that the plastic strips which are adhered to the inner surface of the central panel 11 and extend beyond the edges 12 and 14 are each formed with a cut 42 and 44 transversely of the length of the sheets 30 and 31. The cuts 42 and 44 form multiple flaps along each edge of the opening which extend from the edges of the card stock into the dispensing opening.

Figure 4:
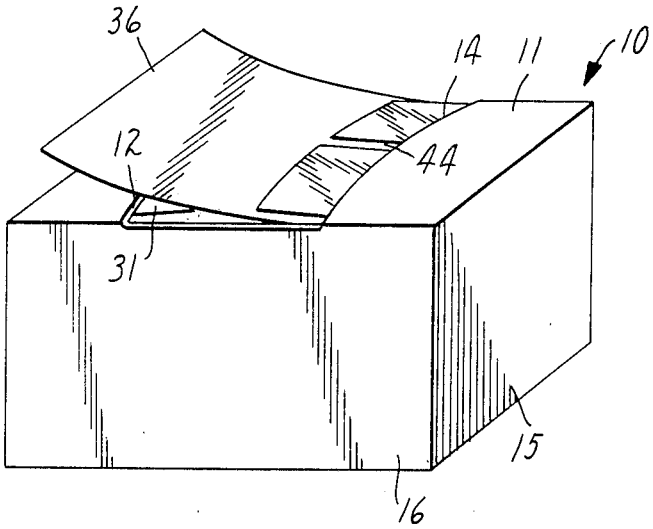
FIG. 4 is a perspective view of a dispenser constructed from the blank of FIG. 3.

As shown in FIG. 4, the multiple flaps provide greater flexibility at the dispensing opening as the initial bending of the flaps does not require as much force to reverse the preformed curl in the flaps resulting from the bow in the card stock adjacent the edges 12 and 14. In this embodiment the bowing of the flaps is formed much the same as in the first embodiment except that less force is required to initially bend the extended flaps transversely of the sheets, i.e., parallel to the edges 12 and 14 and against the initial curl existing in the flaps which is about an axis perpendicular to the transverse dimension of the sheet material 36.

Figure 5:
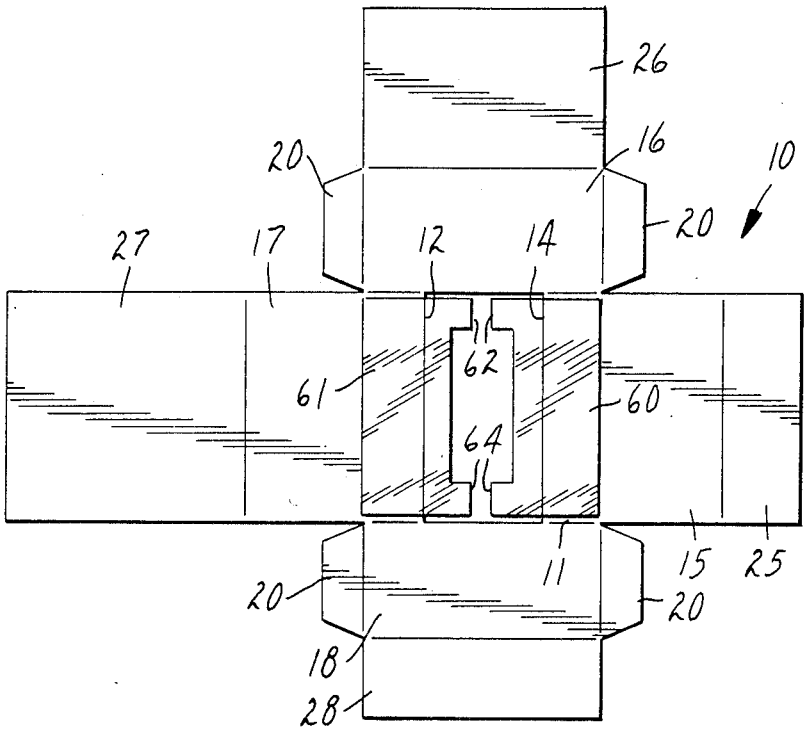
FIG. 5 is a plan view of a further embodiment of a box blank adapted for constructing the dispenser package of the present invention.

FIG. 5 shows a further embodiment of a box blank according to FIG. 1, except the plastic strips 60 and 61 are formed with extended edges 62 and 64 at the transversely spaced ends of the strips. These extended edges are disposed such that they are the first to engage the sheet 36 during the dispensing operation. As the sheet 6 engages the extended edges 62 or 64 the edges transfer the bending force resulting from the dispensing operation along the remainder of the length of the flaps and place a bow in the flaps parallel to the edge 12 or 14 which will engage the sheet as it is withdrawn through the opening between the edges 12 and 14 of the central or top portion of the box 11.

Figure 6:
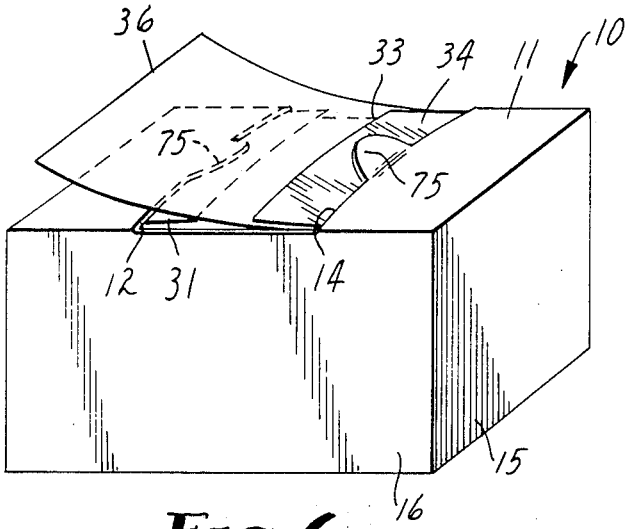
FIG. 6 is a perspective view of a further embodiment of a dispensing package formed in accordance with the present invention.

FIG. 6 shows a further embodiment which corresponds generally to that of FIG. 2 except that the edges 12 and 14 are formed with a tab or projection 75 which extends into the slotted open area therebetween. These projections 75 may fold upwardly upon the initial dispensing of a pair of sheets 36 from the dispenser. These projections serve as support for the sheet extending from the dispenser such that its free edge projects upwardly making the same easy to grasp to withdraw the sheet 36 through the dispenser opening. The flap 34 may readily bow transversely of the opening as the sheet is dispensed, but, the free edge of the successive sheet will then extend through the opening between the flaps and rest on the projection 75, holding the free edge of the sheet above the central or top of the box making it easy to grasp and withdraw the sheet through the opening.

Suitable polymeric materials for the sheets or strips 30, 31, 60 and 61 are plastic films such as polyester, polyethylene, polypropylene, or the like. The material, shape and thickness of the flap must be chosen in concert with the dimensions, and properties of the card stock, and the biasing means placed in the package. A preferred material from which to form the polymeric flaps is a 0.007 inch (0.178 mm) polyester film.

Having thus described the present invention with respect to several embodiments it is to be understood that other changes may be made without departing from the spirit and scope of the invention as defined by the appended claims.

I claim:

1. A dispenser package for sheet material wherein the sheet material is disposed in a stack and the sheets are releasably adhered to each other in the stack along opposite edges of successive sheets by a narrow band of pressure-sensitive adhesive, said package comprising a stack of said sheet material, a card stock box having a bottom, side walls and a top wall, said top wall having an opening extending generally centrally thereof and defined by opposed parallel edges extending the width of the top wall, a-pair of flaps, each flap being formed of polymeric material and said flaps being disposed for one to extend from each interior surface of said top wall on each side of said opening and into the opening beyond each of the opposed edges of the opening, said flaps terminating at terminal edges in opposed spaced relation and each flap having free side edges movable in relationship to the side walls of the box, said flaps being positioned to normally rest on the top of said stack and said polymeric material forming said flaps having the flexibility to form an arcuate bend transversely of the flap between the edge of the opening and the terminal edge of the flap during dispensing of sheets from said stack and having the resiliency to recover the rest on the top of the stack, and biasing means disposed beneath said stack of sheet material for urging the stack of sheet material toward the opening whereby dispensing of a sheet from said stack draws said sheet around said arcuate bend in the flap and draws the successive sheet through a wider opening to restrict the forming of a curl in either sheet.

2. A dispenser package according to claim 1 wherein the flaps are formed of one of polyethylene, polyester and polypropylene.

3. A dispenser package according to claim 1 wherein a plurality of flaps extend from each edge of the opening into the opening.

4. A dispenser package according to claim 1 wherein each flap has an extended projecting end portion adjacent to the sidewalls of the box which extend into the opening beyond the remainder of the flap to afford initial engagement with the sheet material being dispensed.

5. A dispenser package according to claim 1 wherein said biasing means comprises a metal spring.

6. A dispenser package according to claim 6 wherein the spring is formed of convolutely wound wire to form a compression spring.

7. A dispenser package according to claim 1 wherein said biasing means is a block of polymeric foam.

8. A dispenser package according to claim 1 wherein said flaps project from strips of material adhered to the inner surface of said top wall.

9. A dispenser package according to claim 1 wherein said flaps project from a plurality of strips of polymeric material adhered to the inner surface of said top wall.

10. A dispenser package according to claim 1 wherein said box has a projection formed along said opposed edges of the opening which projection extends into the opening and above said flap, whereby said projection will extend above the top wall during dispensing of said sheets.

11. A dispensed package according to claim 1 wherein said box is formed of 20 point solid bleached sulphite and said flaps are formed of polyester having a thickness of 0.007 inch.

* * * * *